United States Patent [19]

Shapiro et al.

[11] 3,932,870

[45] Jan. 13, 1976

[54] ON-LINE TEST CIRCUIT FOR INTRUSION ALARM SYSTEMS

[75] Inventors: L. Dennis Shapiro, Lincoln; Aaron A. Galvin, Lexington, both of Mass.

[73] Assignee: American District Telegraph Company, New York, N.Y.

[22] Filed: May 31, 1974

[21] Appl. No.: 475,057

[52] U.S. Cl. ..... 340/411; 340/214; 343/17.7

[51] Int. Cl.[2] ..... G08B 29/00

[58] Field of Search ..... 340/258 R, 258 A, 214, 340/411, 409; 343/5 PD, 17.7

[56] References Cited

UNITED STATES PATENTS

| | | | |
|---|---|---|---|
| 3,465,336 | 9/1969 | Fishbein et al. | 340/258 A X |
| 3,697,989 | 10/1972 | Bailey et al. | 340/258 A |
| 3,820,114 | 6/1974 | Green | 343/17.7 |
| R23,820 | 5/1954 | Bagno | 340/258 A |

*Primary Examiner*—John W. Caldwell
*Assistant Examiner*—William M. Wannisky
*Attorney, Agent, or Firm*—Weingarten, Maxham & Schurgin

[57] ABSTRACT

For use in an intrusion alarm system, an on-line test circuit operative for the continuous supervision of system operation without affecting normal operation thereof. The transmitted signal is frequently modulated at a low rate to produce a detectable change in reflected energy sensed by sub-Doppler processing circuitry and operative to produce a failure indication in the absence of such sub-Doppler signal.

10 Claims, 5 Drawing Figures

ON-LINE TEST CIRCUIT FOR INTRUSION ALARM SYSTEMS

FIELD OF THE INVENTION

This invention relates to intrusion alarm systems and more particularly to circuitry for the continuous on-line test supervision of system operation.

BACKGROUND OF THE INVENTION

Intrusion alarm systems are known for detecting the presence of a moving intruder or target within a zone under protection. An energy pattern, which may be provided from a sonic, ultrasonic or electromagnetic source, is provided in a protected zone and reflected energy returned from the zone and from objects therein is received and processed to indicate intruder presence. In the presence of a moving intruder, a Doppler or other sensible signal is received and usually is processed to discriminate a moving intruder from fixed background return energy, noise or spurious signals. In the event of a system failure it is useful to provide a fail-safe mode of operation in which an alarm indication is provided upon such failure so that prompt corrective action can be taken.

Various test systems have been proposed to monitor the operation of intrusion alarm systems to ascertain a failure condition. In one type of test system, a Doppler test signal is provided at the system receiver, or the transmitter is modulated with a Doppler signal to provide a corresponding Doppler signal at the receiver, to cause a system alarm indication in the presence of such a test signal. The absence of alarm actuation would be indicative of system failure. Such command-type testing is not an on-line procedure and usually requires the presence of a person to conduct the test and monitor the expected alarm which should appear at test time. In known on-line testing approaches, the transmitter output signal is monitored and the noise level of the receiver output is also monitored to indicate transmitter and receiver operability. However, such on-line testing does not provide a test of overall system operability to assure detection by the system of an intruder.

SUMMARY OF THE INVENTION

According to the invention, on-line test circuitry is provided for an intrusion alarm system and operative for the continuous monitoring thereof and for the rapid indication of a system failure which would prevent detection of an intruder in a protected zone. A frequency modulated (FM) test signal is provided as part of the system transmitted signal which test signal is of sufficiently low modulation frequency to cause return energy having difference frequencies below the Doppler band of the alarm system. Energy reflected from the protected zone and from objects therein is received by the system receiver which provides a corresponding output signal which includes a sub-Doppler test signal detectable by a sub-Doppler signal processor operative to produce a failure indication in the event that the test signal is less than a predetermined signal level. Typically, the modulation rate of the FM test signal is in a sub-sub-Doppler range of less than 1 Hz to produce, over a selected range in the protected zone, typically 10–50 feet, a return signal in the sub-Doppler range of 1–10 Hz. The Doppler band employed by the alarm system for intruder detection is typically 10–400 Hz, and the test signal is of sufficiently low deviation such that very little noise is introduced into the Doppler band as a result of the test signal modulation.

The test signal processor includes a bipolar threshold circuit which provides a bipolar reference threshold, the exceedance of which by the received test signal indicates proper alarm system operability. The presence of a received test signal of magnitude less than the reference threshold or the complete absence of a test signal denotes a substantially degraded or failure condition, as the alarm system is not in that circumstance responsive to received Doppler information to enable detection of an intruder.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
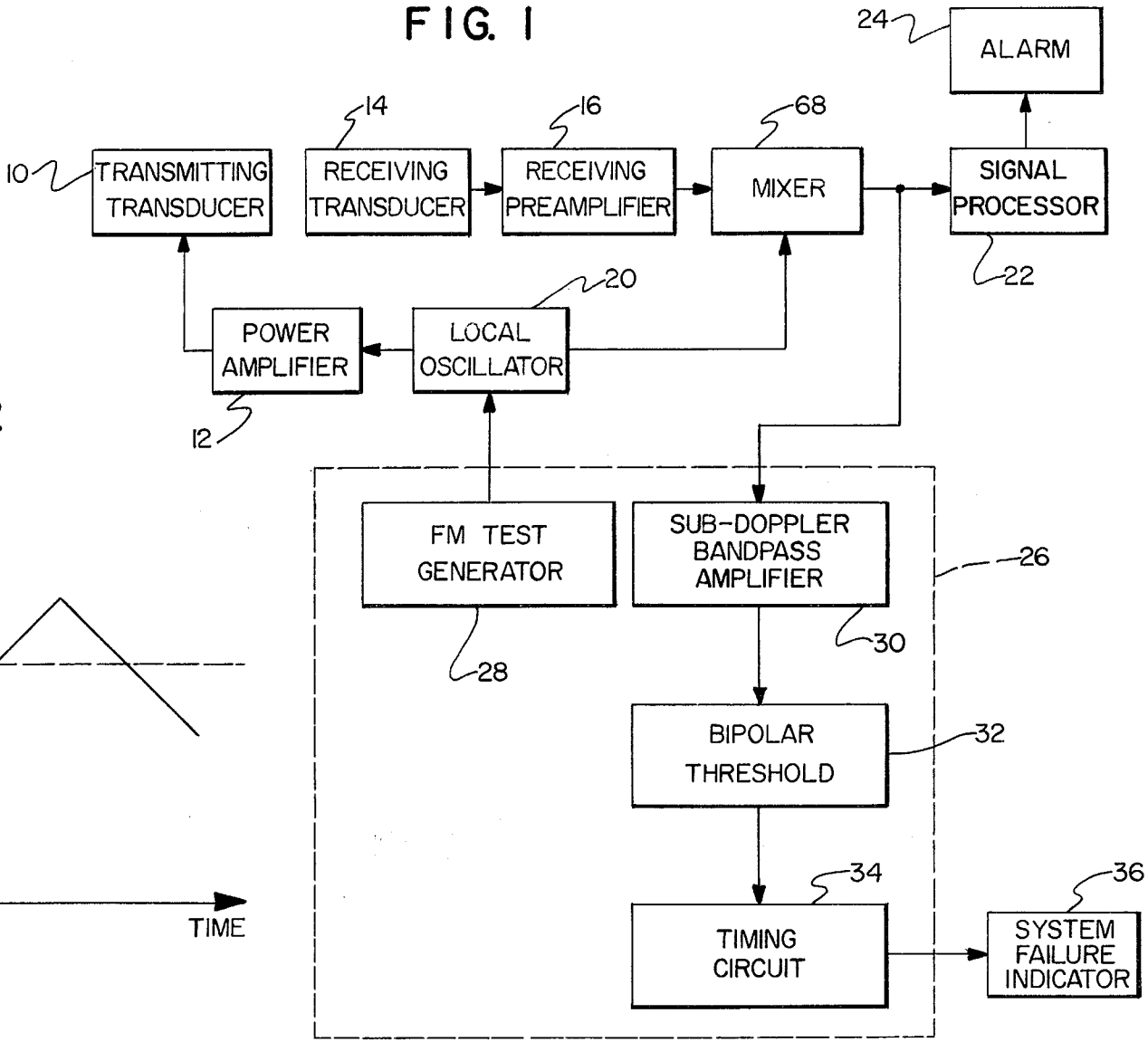
FIG. 1 is a block diagram representation of an intrusion alarm system embodying the invention.

The invention as embodied in a typical intrusion detection system is illustrated in FIG. 1. A transmitting transducer 10 energized by a power amplifier 12 provides energy within a zone being protected, and reflected energy from the zone and from objects therein is received by a receiving transducer 14 which is coupled to a preamplifier 16 which, in turn, is coupled to one input of a mixer 18. A local oscillator 20 provides a second input to mixer 18 and also provides a signal to power amplifier 12. The output of mixer 18 is coupled to signal processing circuitry 22, the output of which is applied to an alarm circuit 24. This intrusion alarm system is itself known in the art and the detailed operation of which is well understood in the art. Such a system is shown for example in U.S. Pat. 3,665,443 assigned to the same assignee as this invention.

In the presence of a moving intruder within a zone under protection, reflected energy received by transducer 14 includes Doppler information which is present as a Doppler signal provided by mixer 18 to signal processing circuitry 22. Circuitry 22 is operative to discriminate true moving target signals from noise or other spurious signals and provide an output signal to alarm circuitry 24 upon detection of a valid moving target. According to the invention, test circuitry is included within the alarm system to continuously monitor, on an on-line basis, system operation to provide a rapid output indication of system failure in such event, while not interfering with system operation in the absence of a failure condition.

Figure 2:
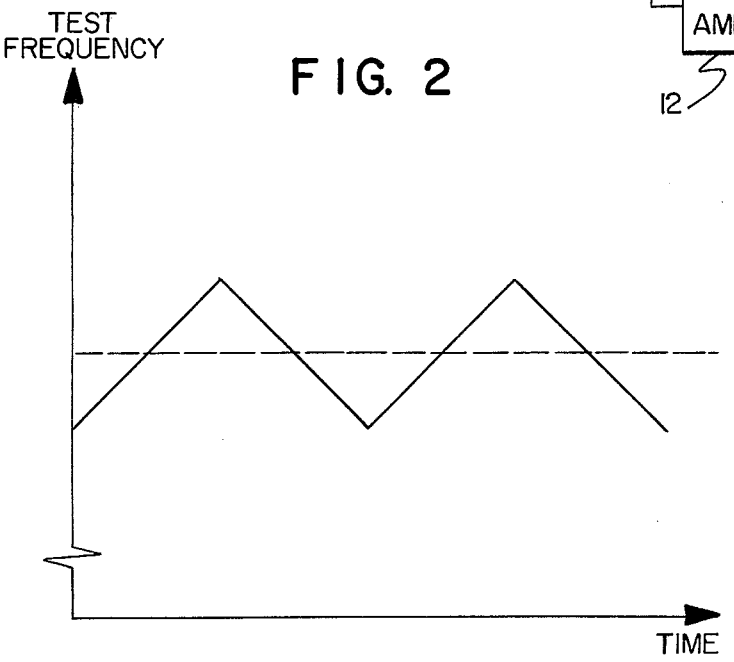
FIG. 2 is a waveform diagram of an FM test signal employed in the invention.

The test circuitry shown generally at 26 includes a sub-sub-Doppler FM sweep generator 28 coupled to local oscillator 20 and operative to provide an FM signal thereto having an FM period and peak-to-peak frequency deviation sufficiently low that very little noise is introduced into the normal Doppler band as a result of this test modulation. For example, in an ultrasonic alarm system operating at a carrier frequency of 26 KHz and having a Doppler band of 10 to 400 Hz, a peak-to-peak deviation of 50 Hz, with a two second period will not, even in the presence of large reflections from a protected zone, produce any Doppler noise of significant magnitude. The test signal waveform is shown in FIG. 2 and is seen to be linearly swept in a repetitive manner symmetrically about the carrier frequency of the alarm system. Alternatively, sinusoidal or similar or similar waveform may be used. A sub-Doppler band pass amplifier 30 is coupled to the output of mixer 18 and provides an output signal to a bipolar threshold circuit 32, the output of which, in turn, is coupled to a timing circuit 34 which provides an output signal to a failure indicator 36.

In operation, the FM test signal provided by generator 28 causes corresponding modulation of the energy provided by transducer 10 to the zone under protection. The delay in the normal reflection or backscatter from this zone causes a detectable sub-Doppler signal to appear as part of the output signal of mixer 18. This sub-Doppler signal is detected by sub-Doppler bandpass amplifier 30 which provides an output signal upon receipt of such sub-Doppler return energy. The threshold circuit 32 establishes a bipolar reference threshold level. If the threshold is not exceeded within a predetermined time interval defined by circuit 34, usually several cycles of the FM test signal, an output indication of system failure is provided by circuit 34 to failure indicator 36.

As an example of the operation of the invention, assume an FM test signal as described above with a primary source of backscatter in a protected zone at a range of 10 feet from transducers 10 and 14. The round trip propagation path from transducer 10 to the source of backscatter and thence to transducer 14 is therefore 20 feet, which results in a propagation delay between the transmit and receiving times of approximately 20 milliseconds. The transmitted FM test signal and the received version thereof are offset as a result of the delay time causing a difference frequency of approximately 1 Hz and having a polarity dependent upon whether detection is accomplished during the positive going or negative going portion of the FM test signal. The 1 Hz signal is detected by the sub-Doppler processing circuitry and such test signal does not affect the normal alarm signal processing circuitry since the test signal is below the frequency range of such alarm circuitry. The sub-Doppler frequency band contains significant energy only if the system senses a substantial delay in reflected energy which gives rise to a detectable sub-Doppler test signal. In the presence of such test signal, the bipolar threshold is exceeded and no failure indication is provided since the system is then functioning properly.

Figure 3:
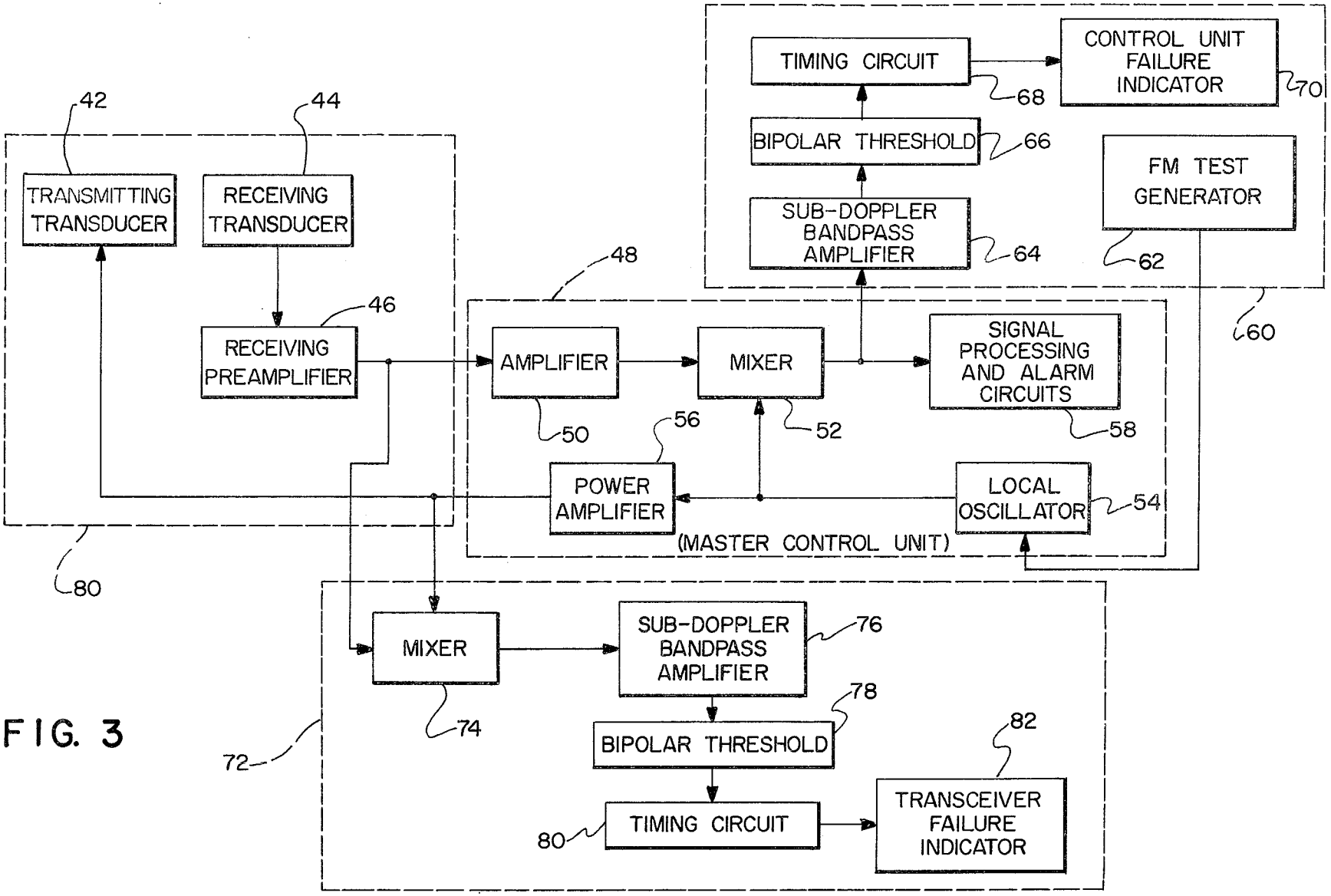
FIG. 3 is a block diagram representation of an alternative embodiment of the invention useful with multiple transducer intrusion alarm systems.

In the embodiment of FIG. 1 the invention is shown with an intrusion alarm system having a single transmitting transducer and receiving transducer such as employed in monitoring a single area or zone. Many intrusion alarm systems employ multiple transmitting and receiving transducers for monitoring plural zones, and the invention as embodied for use in such a multiple zone system is illustrated in FIG. 3. A transceiver 40 is provided for each zone under surveillance and includes a transmitting transducer 42, a receiving transducer 44 and a preamplifier 46. The preamplifier 46 is coupled to a master control unit 38 which includes an amplifier 50 coupled to a mixer 52 which also receives a signal from a local oscillator 54. Local oscillator 54 also drives a power amplifier 56 the output of which is coupled to transducer 42 of each transceiver 40. The output of mixer 52 is applied to signal processing and alarm circuitry 58.

Test circuitry 60 is associated with the master control unit 48 and includes a sub-sub-Doppler FM sweep generator 62 coupled to local oscillator 54 and a sub-Doppler bandpass amplifier 64 receiving the output signal from mixer 52. Bandpass amplifier 64 is coupled to bipolar threshold circuit 66 which in turn is coupled to timing circuit 68. Timing circuit 68 is coupled to a failure indicator 70. Each transceiver 40 includes a test circuit 72 which includes a mixer 74 receiving signals from power amplifier 56 and from preamplifier 46 and provides an output signal to sub-Doppler bandpass amplifier 76 which is coupled to a bipolar threshold circuit 78 which is coupled to a timing circuit 80 providing an output signal to a failure indicator 82. A mixer 74 is provided in the transceiver test circuit, since the transceiver does not include an individual mixer as in the master control unit. The test control circuit 72 can be physically disposed with respective transceivers or alternatively can be located in the master control unit and interconnected with the transceiver via appropriate wiring.

Operation of the system of FIG. 3 is substantially the same as described above. A system failure occurring in any one of the transceivers 40 or in the master control unit 48 will cause a failure indication to appear. In the event that failure occurs in the master control unit alone, only indicator 70 will be energized. In the event that failure occurs in one of the transceivers 40, such failure will be indicated by energization of the corresponding indicator 82 as well as indicator 70 of the master control unit.

Figure 4:
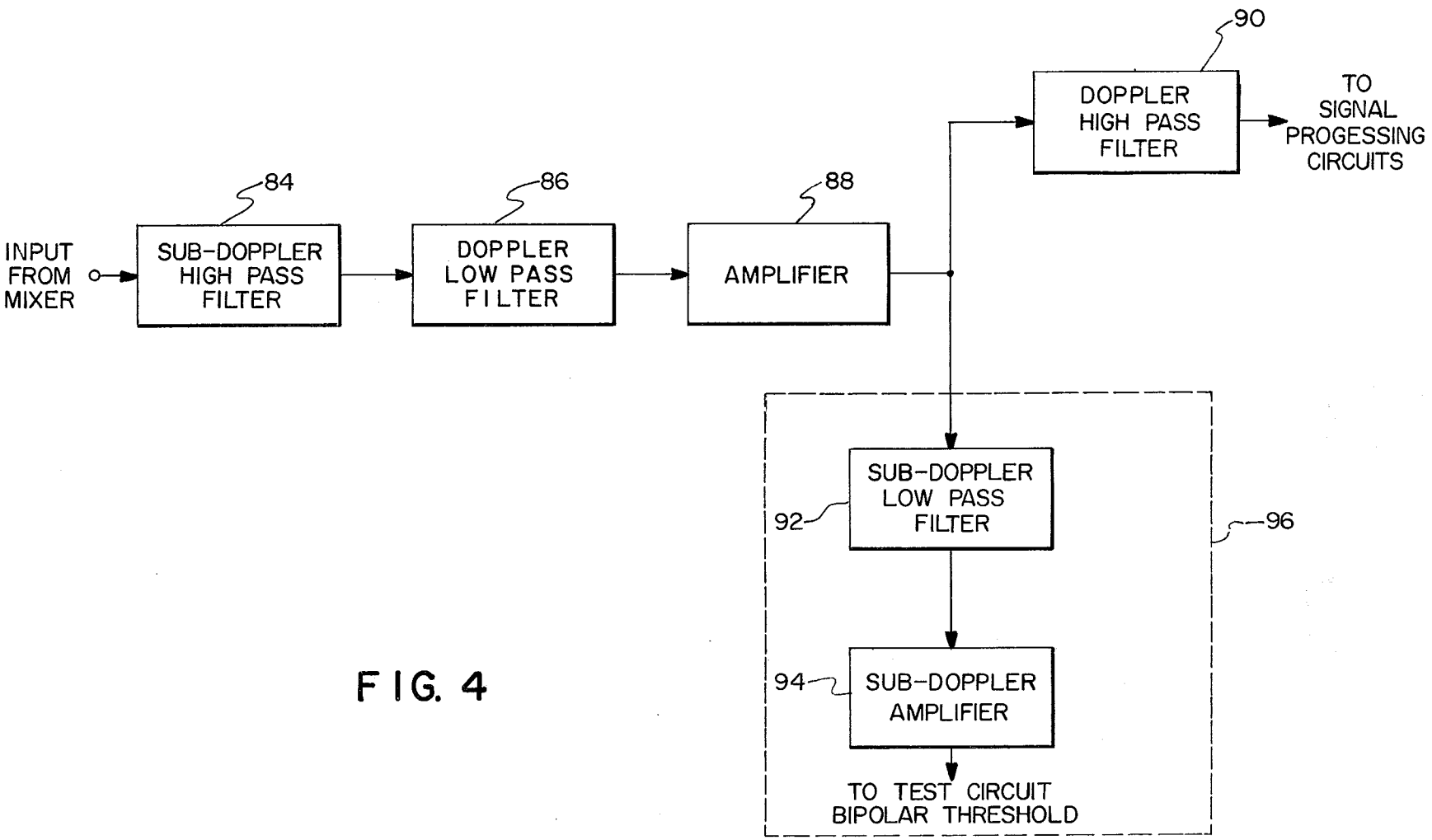
FIG. 4 is a block diagram representation of a further embodiment of the invention.

FIG. 4 depicts a test circuit having an input signal thereto alternatively derived than in the embodiments described above. In the embodiment of FIG. 4, the alarm system includes as part of the signal processing circuitry a sub-Doppler high pass filter 84 coupled to a Doppler low pass filter 86 which, in turn, is coupled to a Doppler amplifier 88. The output of amplifier 88 is applied to a Doppler high pass filter 90 the output of which is applied to subsequent signal processing circuits for processing of the signals in well known manner to provide an alarm indication in the presence of a moving target. The amplifier output signals are also applied to a sub-Doppler low pass filter 92, the output of which is coupled to a sub-Doppler amplifier 94, both of test circuit 96. The output of amplifier 94 is applied to a bipolar threshold circuit such as described above. Sub-Doppler information is present at the output of amplifier 88 for processing by test circuit 96 for on-line monitoring of system performance. Doppler information is also present at the output of amplifier 88 for processing to indicate target detection. This embodiment of FIG. 4 provides a measure of proper system operability for elements of the system including the Doppler amplifier, whereas in the embodiments described above the system is monitored only to the input of the normal signal processor.

Figure 5:
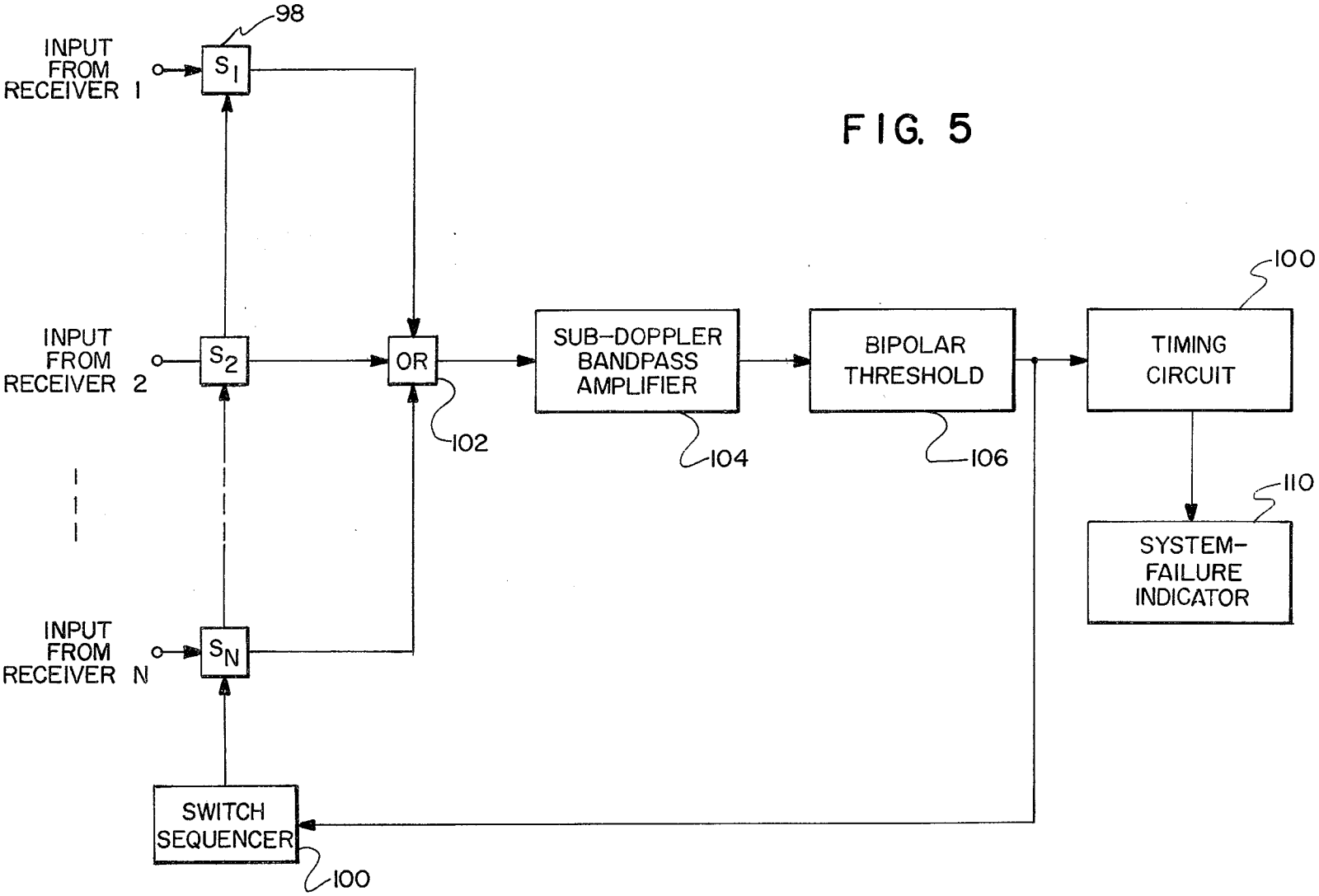
FIG. 5 is a block diagram representation of an embodiment useful in multiple transducer intrusion alarm system.

The embodiment of FIG. 5 provides a test circuit which is shared with a plurality of transceivers to provide a failure indication upon failure of any one of the transceivers or the common control circuitry. An FM test signal is provided as in the embodiments described. Referring to FIG. 5, the output of respective transceivers is applied to respective gates 98, each of which is enabled by a signal from a sequencer 100. The output of each gate 98 is coupled to an input of an OR gate 102, the output of which is applied to sub-Doppler bandpass amplifier 104. The output of amplifier 104 is applied to bipolar threshold 106 and thence to a timing circuit 108, the output of which drives failure indicator 110. The output signal from threshold circuit 106 is also applied as an input to sequencer 100. The sequencer enables gates 98 in a sequential manner to observe the signal from respective transceivers. If a sub-Doppler output signal of sufficient amplitude is not present at the ouput of amplifier 104, the threshold level provided by circuit 106 is not exceeded and the signal from timing circuit 108 causes actuation of failure indicator 110. The presence of a signal of sufficient amplitude to exceed the reference threshold causes application of an input signal to sequencer 100 to cause cycling to the next sampling position. Thus, the test circuitry is sequentially operative with all of the system transceivers to monitor operation thereof.

Under certain circumstances, the invention can be employed to monitor system operability by detection of a sub-Doppler signal derived from energy returned from the protected zone without a test signal being employed. In many instances, there is sufficient air motion or turbulence within a protected zone to produce a sub-Doppler modulation of energy returned from the zone and which is sensible to derive the sub-Doppler signal for providing an output indication of system failure. The invention in this alternative mode is operative as described hereinabove but without need for provision of a transmitted test signal.

It will be appreciated that the invention is useful with different types of intrusion alarm systems including ultrasonic, radio frequency and microwave Doppler systems. It will also be appreciated that the invention can be implemented in various ways to suit specific system requirements. Accordingly, it is not intended to limit the invention by what has been particularly shown and described except as indicated in the appended claims.

What is claimed is:

1. For use in a Doppler intrusion alarm system having means for transmitting energy into a surveillance zone, means for receiving energy returned from said zone and from objects therein, and means for detecting the presence of a moving intruder in said zone, circuitry for the continuous on-line monitoring of system operability comprising:

means for providing an FM test signal to said transmitting means to cause provision of a varying energy pattern in said surveillance zone having difference frequencies below the Doppler band of said system;

means coupled to said receiving means for detecting a sub-Doppler signal derived from said energy returned from said zone and from objects therein; and means for providing an output indication of system failure in the event that said sub-Doppler signal does not exceed a predetermined reference threshold.

2. The invention according to claim 1 wherein said output providing means includes:

means for establishing said reference threshold;

means for defining a time interval within which said reference threshold must not be exceeded in order to provide said output indication of system failure.

3. The invention according to claim 1 wherein said test signal providing means includes an FM generator coupled to the local oscillator of said transmitting means to vary the output frequency thereof for providing said varying energy pattern.

4. The invention according to claim 1 wherein said sub-Doppler signal detecting means includes a sub-Doppler bandpass amplifier operative in response to signals returned from said surveillance zone to provide a sub-Doppler signal derived from said returned energy.

5. The invention according to claim 2 wherein said threshold means is a bipolar threshold circuit.

6. The invention according to claim 2 wherein said sub-Doppler signal detecting means includes:

a sub-Doppler high pass filter;

a Doppler low pass filter;

a Doppler amplifier providing output signals which may contain both Doppler and sub-Doppler information; and a sub-Doppler low pass filter receiving the output signals from said Doppler amplifier and providing an output signal representative of the sub-Doppler signal content of said amplifier output signal.

7. For use in a Doppler intrusion alarm system having a plurality of transceivers each associated with a respective surveillance zone and each operative to transmit energy into said zone and to receive energy returned therefrom, and means responsive to said returned energy for detecting the presence of a moving intruder in said zones, circuitry for the continuous on-line monitoring of system operability comprising:

means for providing an FM test signal to the transmitting means of each of said transceivers to cause provision of a varying energy pattern in said surveillance zone having difference frequencies below the Doppler band of said system;

a plurality of test means each coupled to the receiving means of a respective one of said transceivers and each including means for detecting a sub-Doppler signal derived from said returned energy;

means for establishing a reference threshold; and means for providing an output indication of transceiver failure in the event that said sub-Doppler signal does not exceed said reference threshold within a predetermined time interval.

8. The invention according to claim 7 including:

test means coupled to said system detecting means and having means for detecting a sub-Doppler signal derived from said returned energy;

means for establishing a reference threshold; and means for providing an output indication of system detecting means failure in the event that said sub-Doppler signal does not exceed said reference threshold within a predetermined time interval.

9. For use in a Doppler intrusion alarm system having a plurality of transceivers each associated with a respective surveillance zone and each operative to transmit energy into said zone and to receive energy returned therefrom, and means responsive to said returned energy for detecting the presence of a moving intruder in said zones, circuitry for the continuous on-line monitoring of system operability comprising:

a plurality of gates each receiving signals from a respective one of said transceivers derived from said returned energy and including a sub-Doppler signal;

means for detecting said sub-Doppler signal;

means for coupling each of said gates to said sub-Doppler signal detecting means;

means for establishing a reference threshold;

means for providing an output indication of system failure in the event that said sub-Doppler signal does not exceed said reference threshold within a predetermined time interval; and means operative in response to said sub-Doppler signal exceeding said reference threshold to sequentially enable said gates to permit sequential sampling of returned energy from said zones.

10. For use in a Doppler intrusion alarm system having means for transmitting energy into a surveillance zone, means for receiving energy returned from said zone and from objects therein, and means for detecting the presence of a moving intruder in said zone, circuitry for the continuous on-line monitoring of system operability comprising:

means coupled to said receiving means for detecting a sub-Doppler signal derived from said energy returned from said zone and from objects therein; and means for providing an output indication of system failure in the event that said sub-Doppler signal does not exceed a predetermined reference threshold.

* * * * *